US012012953B2

(12) United States Patent
Deem

(10) Patent No.: US 12,012,953 B2
(45) Date of Patent: Jun. 18, 2024

(54) LIQUID RESISTANT PUMP, PUMP HOUSING, AND CONTROLS AND METHODS OF MAKING AND USE THEREOF

(71) Applicant: Masterflex, LLC, Radnor, PA (US)

(72) Inventor: Jeffrey Deem, Lake in the Hills, IL (US)

(73) Assignee: Masterflex, LLC, Radnor, PA (US)

( * ) Notice: Subject to any disclaimer, the term of this patent is extended or adjusted under 35 U.S.C. 154(b) by 0 days.

(21) Appl. No.: 17/507,065

(22) Filed: Oct. 21, 2021

(65) Prior Publication Data

US 2022/0136499 A1 May 5, 2022

Related U.S. Application Data

(60) Provisional application No. 63/108,744, filed on Nov. 2, 2020.

(51) Int. Cl.

| | |
|---|---|
| ***F04B 53/16*** | (2006.01) |
| ***F04B 17/03*** | (2006.01) |
| ***F04B 49/06*** | (2006.01) |

(52) U.S. Cl.

CPC ..... *F04B 53/16* (2013.01); *F04B 17/03* (2013.01); *F04B 49/065* (2013.01)

(58) Field of Classification Search

CPC ..... F04B 17/03; F04B 53/16; F04B 43/08; F04B 43/09; F04B 43/12; A61M 5/14244; A61M 5/14232; A61M 5/142; H04M 1/026; H04M 1/0266; G06F 1/1637; G02F 1/13332

(Continued)

(56) References Cited

U.S. PATENT DOCUMENTS 8,546,984 B2 * 10/2013 Heilman ..... F04B 49/065 349/58
2011/0228192 A1 * 9/2011 Hollaway ..... G02F 1/13338 445/24

(Continued)

FOREIGN PATENT DOCUMENTS

| | | |
|---|---|---|
| CN | 208126357 U | 11/2018 |
| EP | 3546751 A1 | 10/2019 |
| GB | 2538556 A | 11/2016 |

OTHER PUBLICATIONS

Extended European Search Report for related EP Application No. 21206008.1, dated Mar. 21, 2022, 7 pages.

*Primary Examiner* — Philip E Stimpert
(74) *Attorney, Agent, or Firm* — Faegre Drinker Biddle & Reath LLP

(57) ABSTRACT

A pump assembly including a motor and a housing forming an enclosure cavity to enclose the motor. The pump assembly also including a display assembly with a mounting frame mounted to the housing and having an opening for viewing a display. The display assembly also including a gasket positioned between the mounting frame and the housing. The display assembly also including one or more membranes positioned between the frame and the display. The pump assembly also including a pumphead connection assembly positioned on a second surface of the housing. The pump assembly also including an access panel hingedly attached to the housing and positioned to cover the pumphead connection assembly.

17 Claims, 11 Drawing Sheets

(58) Field of Classification Search
USPC ..... 349/58, 60
See application file for complete search history.

(56) References Cited

U.S. PATENT DOCUMENTS

| | | | | |
|---|---|---|---|---|
| 2015/0189963 | A1* | 7/2015 | Lai | H04B 1/3888<br>224/191 |
| 2018/0094624 | A1* | 4/2018 | Kabasta, Jr. | F04B 53/10 |
| 2018/0187782 | A1* | 7/2018 | Slaby | F16J 15/104 |

* cited by examiner

LIQUID RESISTANT PUMP, PUMP HOUSING, AND CONTROLS AND METHODS OF MAKING AND USE THEREOF

CROSS-REFERENCE TO RELATED APPLICATION(S)

This application claims the benefit of U.S. Provisional Application No. 63/108,744, entitled "Liquid Resistant Pump, Pump Housing, and Controls and Methods of Making and Use Thereof" and filed on Nov. 2, 2020, which is expressly incorporated by reference herein in its entirety.

FIELD

Aspects of the present disclosure relate to liquid resistant pumps, pump housings, and controls and methods of making and use thereof.

BACKGROUND

Fluid handling apparatuses such as pumps are used in various environments to supply fluids. For example, pumps may operate unattended for continuous laboratory or manufacturing processes. However, the handling of fluids by a pump may expose various components of the pump and/or the pump drive to the fluids. Exposure by the pump to the fluids may cause these components to malfunction.

Therefore, an unmet need remains in the related art for a pump drive to resistant to fluid exposure, among other needs.

SUMMARY

The following presents a simplified summary of one or more aspects of the present disclosure in order to provide a basic understanding of such aspects. This summary is not an extensive overview of all contemplated aspects, and is intended to neither identify key or critical elements of all aspects, nor delineate the scope of any or all aspects. Its purpose is to present some concepts of one or more aspects in a simplified form as a prelude to the more detailed description that is presented later.

In an aspect, a liquid resistant pump assembly is presented. The pump assembly may include a motor and a housing forming an enclosure cavity to enclose the motor. The pump assembly may also include a display assembly including a display for controlling and monitoring the pump. The pump assembly may include a pumphead connection assembly positioned on a second surface of the housing. The pump assembly may also include an access panel hingedly or otherwise attached to the housing and positioned to selectively cover the pumphead connection assembly.

These and other aspects of the present disclosure will become more fully understood upon a review of the detailed description, which follows.

BRIEF DESCRIPTION OF THE DRAWINGS

The features believed to be characteristic of aspects of the disclosure are set forth in the appended claims. In the description that follows, like parts are marked throughout the specification and drawings with the same numerals. The drawing figures are not necessarily drawn to scale and certain figures may be shown in exaggerated or generalized form in the interest of clarity and conciseness. The disclosure itself, however, as well as a preferred mode of use and further advantages thereof, will be best understood by reference to the following detailed description of illustrative aspects of the disclosure when read in conjunction with the accompanying drawings, wherein:

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known components are shown in block diagram form in order to avoid obscuring such concepts.

Aspects of the present disclosure provide a liquid resistant enclosure assembly for a pump. The enclosure assembly may include a housing forming an enclosure cavity to enclose a pump. The enclosure assembly may also include a display assembly having a mounting frame mounted to or mountable to the housing and having an opening for viewing a display, a gasket positionable between the mounting frame and the housing, and one or more membranes positionable between the frame and the display. The enclosure assembly may also include a pumphead connection assembly positioned on a second surface of the housing. The enclosure assembly may also include an access panel hingedly or otherwise attached to the housing and positionable to cover the pumphead connection assembly.

Turning to the figures, various features in accordance with aspects of the present disclosure will be discussed in more detail below.

Figure 1:
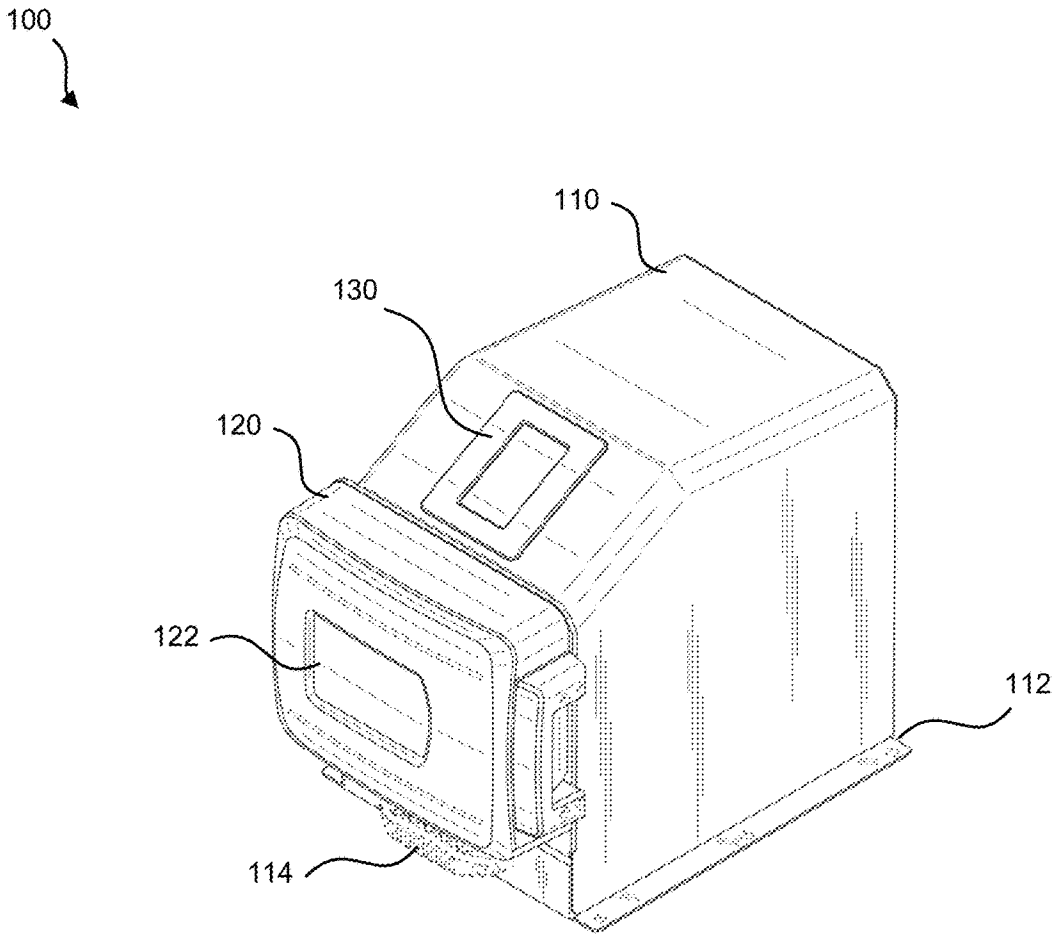
FIG. 1 is a perspective view of an example liquid resistant pump, according to aspects of the present disclosure.
Figure 2:
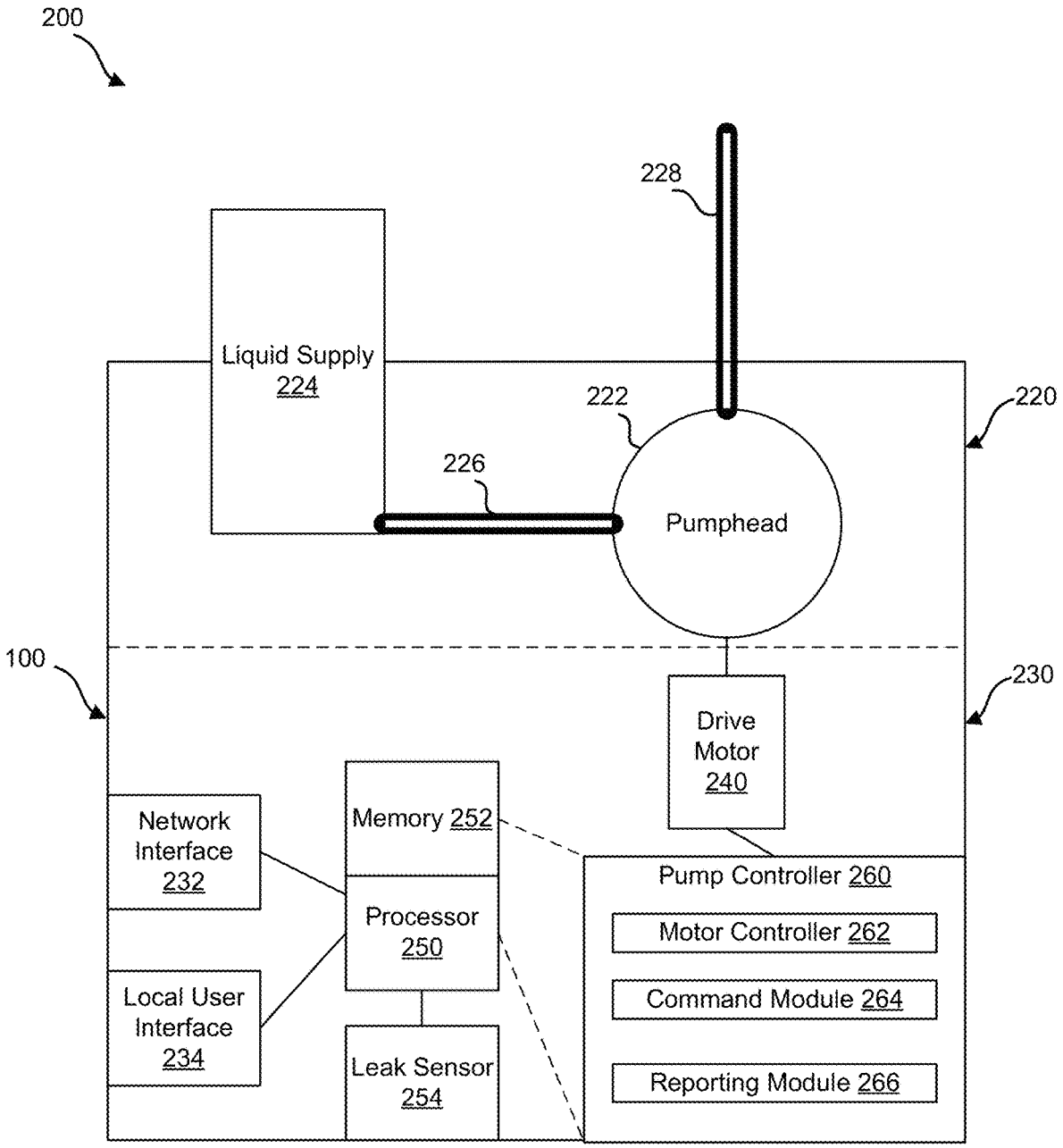
FIG. 2 is a block diagram of an example pump assembly including the liquid resistant pump of FIG. 1, according to aspects of the present disclosure.

FIG. 1 illustrates a perspective view of various aspects of an example enclosure assembly 100 for a liquid resistant pump according to aspects of the present disclosure. The enclosure assembly 100 may enclose various features of a liquid resistant pump, as shown and described further in conjunction with FIGS. 2-4 below. In some implementations, the enclosure assembly 100 may include a housing 110 formed to support and contain various components, including mechanical components, electrical components, hydraulic components, and/or other components (e.g., wet end 220 and control end 230, as shown in FIG. 2). The housing 110 may be formed of a non-corroding material, such as stainless steel. The housing 110 may include an access panel 120 for accessing one or more connections to the wet end of a pump assembly (e.g., wet end 220 of pump assembly 200 as shown in FIG. 2). The access panel may be hingedly or otherwise suitably attached to the housing 110. In an example, the access panel 120 may include a viewing panel 122 for viewing the one or more connections to the wet end 220 (FIG. 2).

As shown in FIG. 1, the enclosure assembly 100 may include a display 130, which may be an example of a local user interface usable with a pump assembly 200 (FIG. 200). The display 130 may display information related to the operation and/or status of the pump assembly 200 (FIG. 2). In an example, the display 130 may be a touch sensitive display, such as a capacitive touch sensitive display, a resistive touch sensitive display, etc. As described in more detail herein, the display 130 may be configured to prevent fluid entering or exiting the housing 110, and interfering with the operation of the display 130.

The housing 110 may include a base 112 for mounting the pump assembly 200 to a structure, such as a table, a stand, a base, such as a floor, or the ground. In an example, the base 112 may be detachably coupled to the housing 110. The housing 110 may also include one or more handles 114 for moving the enclosure assembly 110. In an example, the one or more handles 114 may be formed of stainless steel.

FIG. 2 is a representative block diagram of an example pump assembly 200 usable in accordance with aspects of the present disclosure. In an example, the pump assembly 200 may include a positive displacement pump including communications hardware (e.g., network interface) and software described herein for providing remote control of the pump assembly 200. In an aspect, the pump assembly 200 may operate, for example, in a local mode, in which a local user interface is used to control operation of the pump assembly 200, or a remote mode, in which commands received via a network interface or other remotely originated delivery may be used to control operation of the pump assembly 200.

In an aspect, the term "positive displacement pump" as used herein describes a category of fluid pumps that may contain or "trap" a fixed amount of fluid, such as within a portion of flexible tubing, and force the trapped fluid to a discharge pipe. Positive displacement pumps may be conventionally used in processes that require precise measurement or dosing of fluid, for example. Positive displacement pumps may be driven by an electric motor under the control of a controller (e.g., electronic control unit (ECU) and/or other processor) that may move fluid at a desired rate. In an aspect, a positive displacement pump may include a detachable pumphead that includes a casing and fluid contacting components of the positive displacement pump. The pumphead may be driven by the motor via a magnetic coupling, for example. The positive displacement pump may be fitted with variable pumpheads, depending on the desired operation. For example, in an example implementation, a positive displacement pump may include a housing that encompasses and/or incorporates the drive motor, controller, and user interface, and a detachable pumphead may be fitted in or on the housing. The selection of different pumpheads may configure the pump assembly 200 as, for example, one of a peristaltic pump, gear pump, or diaphragm pump.

In an aspect, the pump assembly 200 may include a wet end 220 and a control end 230. The wet end 220 may include fluid handling components, such as a pumphead 222, a liquid supply or feature for communicating with a liquid supply 224, an inlet tube 226, and an outlet tube 228. The wet end 220 may be detachable from the control end 230 to allow replacement or substitution of the wet end 220. For example, different pumpheads 222 may be selected for use in pumping different fluids.

The pumphead 222 may include a mechanism for pumping fluid. In an aspect, the pump assembly 200 may use a pumphead 222 that allows precise monitoring of the fluid being pumped (e.g., volume pumped). Examples of the pumphead 222 may include a peristaltic pumphead, a quaternary diaphragm pumphead, and/or a gear pumphead. The pumphead 222 may be connected to a liquid supply 224 via an inlet tube 226. The pumphead 222 may pump the fluid to the outlet tube 228. In an aspect, for example, using a peristaltic pump, the inlet tube 226 and the outlet tube 228 may be or include a continuous tube extending through the pumphead 222.

In an aspect, the enclosure assembly 100 may include the control end 230. The control end 230 may include electronic and other pump operational control related components of the pump assembly 200. For example, the control end 230 may include a network interface 232, a local user interface 234, a drive motor 240, a processor 250, a memory 252, and a leak sensor 254. Further, the memory 252 may store instructions executable by the processor 250 for implementing a pump controller 260, which may include, for example, various instructions for carrying out operation of a motor controller 262, a command module 264, and a reporting module 266.

The network interface 232 may include a wired or wireless network interface for transmitting and receiving data packets, for example. In an aspect, the network interface 232, for example, may utilize transmission control protocol/Internet protocol (TCP/IP) packets that may carry commands, parameters, or data. For example, the network interface 232 may receive message queuing telemetry transport (MQTT) messages. The network interface 232 may forward commands to the processor 250 for processing by the pump controller 260. Conversely, the network interface 232 may receive data generated by the pump controller 260 from the processor 250 and transmit the data to a command server.

The local user interface 234 may include any suitable controls provided on the pump assembly 200 for controlling components of the pump assembly 200. In an example implementation, the local user interface 234 may include or be coupleable to a display screen or touchscreen that presents menus for selecting commands similar to the commands transmitted by a command server. In another aspect, the local user interface 234 may include dedicated buttons and/or other selection features that perform specific commands. For example, the local user interface 234 may include a button for selection to start/stop pumping. The local user interface 234 may generate commands to the processor 250 for processing by the pump controller 260. In an aspect, the pump assembly 200 may be configured to selectively operate in a remote mode, for example, in which the local user interface 234 is at least partially disabled to prevent or inhibit local input.

The drive motor 240 may be or include an electric motor that provides a rotational or other output for pumping the fluid. In an aspect, the drive motor 240 may be magnetically coupled to the pumphead 222 to drive the pumphead 222. The drive motor 240 may be controlled by the pump controller 260. For example, the pump controller 260 may generate a control signal indicating a speed and direction of the drive motor 240 based on received commands.

The processor 250 may include one or more processors for executing instructions. An example of processor 250 may include, but is not limited to, any suitable processor specially programmed as described herein, including a controller, microcontroller, application specific integrated circuit (ASIC), field programmable gate array (FPGA), system on chip (SoC), or other programmable logic or state machine. The processor 250 may include other processing components, such as an arithmetic logic unit (ALU), registers, and a control unit. The processor 250 may include multiple cores and may be able to process different sets of instructions and/or data concurrently using the multiple cores to execute multiple threads, for example.

The memory 252 may be configured for storing data and/or computer-executable instructions defining and/or associated with the pump controller 260, and processor 250 may execute such instructions with regard to operation of the pump controller 260. The memory 252 may represent one or more hardware memory devices accessible to processor 250. An example of the memory 252 can include, but is not limited to, a type of memory usable by a computer, such as random access memory (RAM), read only memory (ROM), tapes, magnetic discs, optical discs, volatile memory, non-volatile memory, and any combination thereof. The memory 252 may store local versions of a pump controller application being executed by processor 250, for example.

The leak sensor 254 may be or include a hardware leak sensor that detects whether liquid is leaking within or from the pump assembly 200. For example, a leak may occur when a component of the wet end 220 fails or becomes detached. In such a situation, the inlet tube 226 or the outlet tube 228 may rupture or become detached from the pumphead 222. In an aspect, the leak sensor 254 may include an electronic mesh that forms a circuit when liquid is present. The leak sensor 254 may be coupled to the processor 250, which may generate a stop command to stop operation of the pump assembly 200 in response to the leak sensor 254 detecting a leak. Stopping the pump assembly 200 may prevent damage to the pump and waste of a fluid, for example. Further, a notification of the leak may be used to abort or modify a process using the pump assembly 200.

The pump controller 260 may control operation of the pump assembly 200 based on commands received from either the network interface 232 or the local user interface 234, for example. The pump controller 260 may include a motor controller 262 for controlling operation of the drive motor 240, a command module 264 for interpreting and executing received commands, and/or a reporting module 266 for monitoring pump operation and reporting data regarding the pump assembly 200.

Figure 3A:
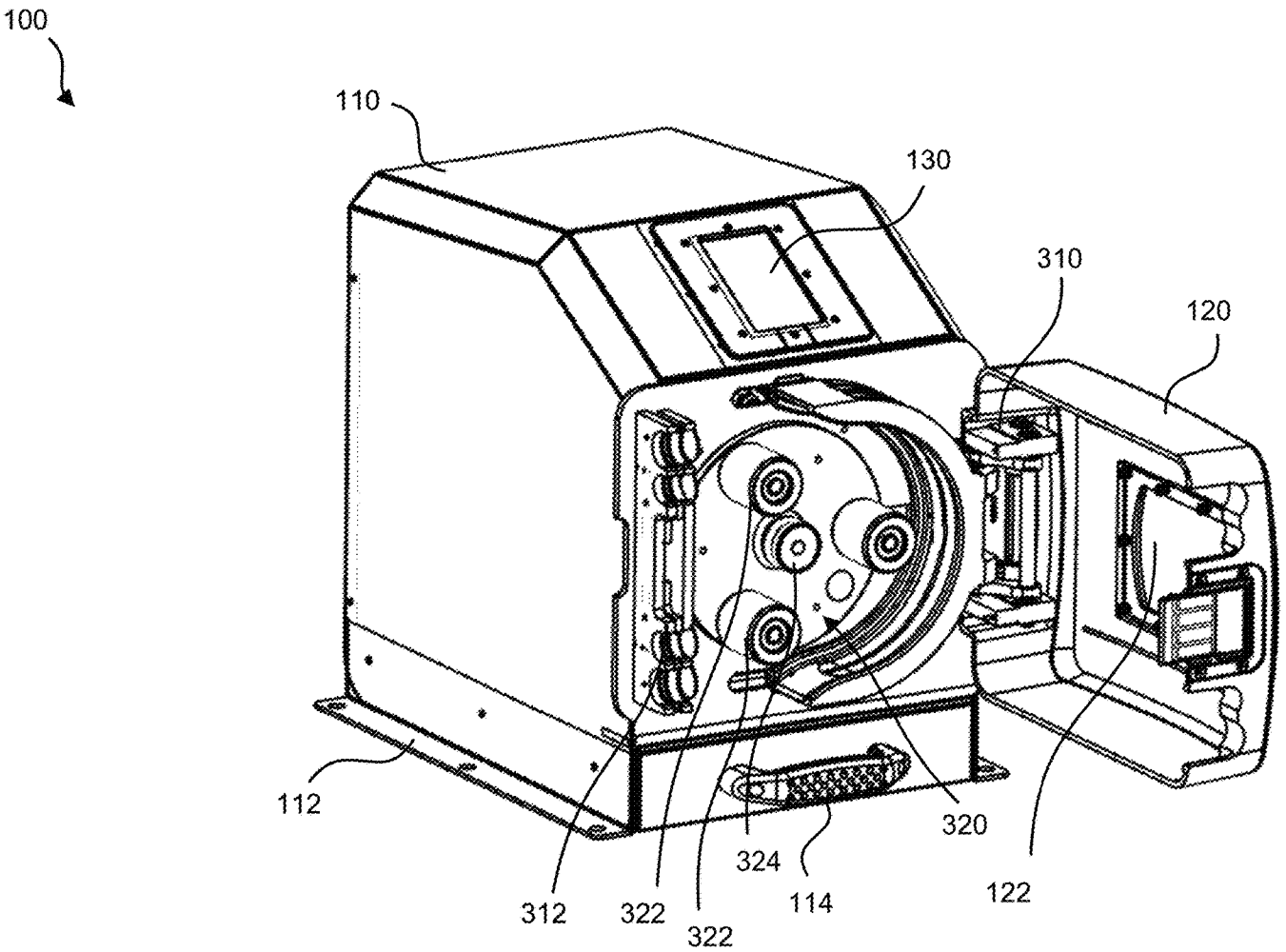
FIG. 3A-3E are schematic views of the liquid resistant pump of FIG. 1, according to aspects of the present disclosure.
Figure 3B:
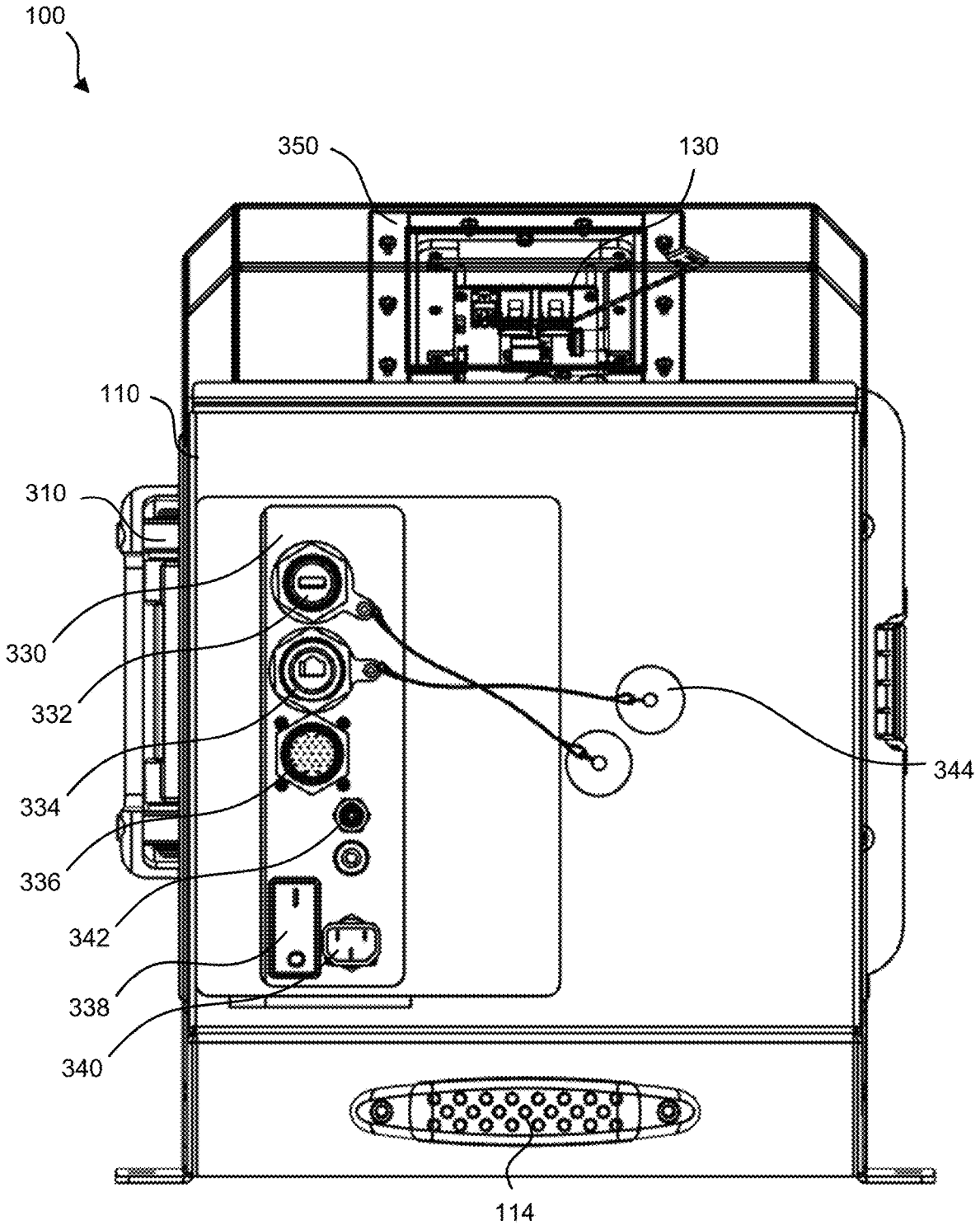
Figure 3C:
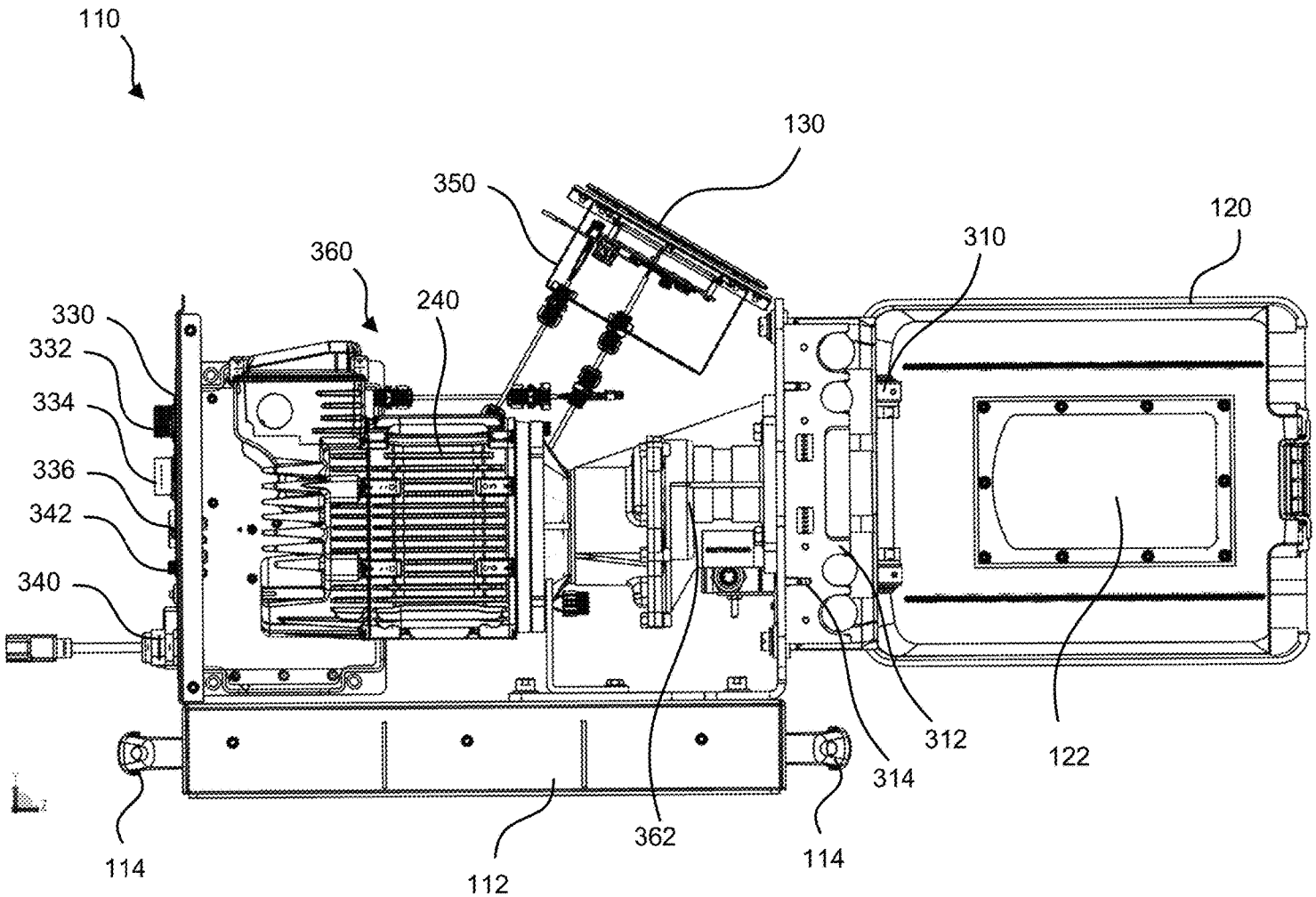
Figure 3D:
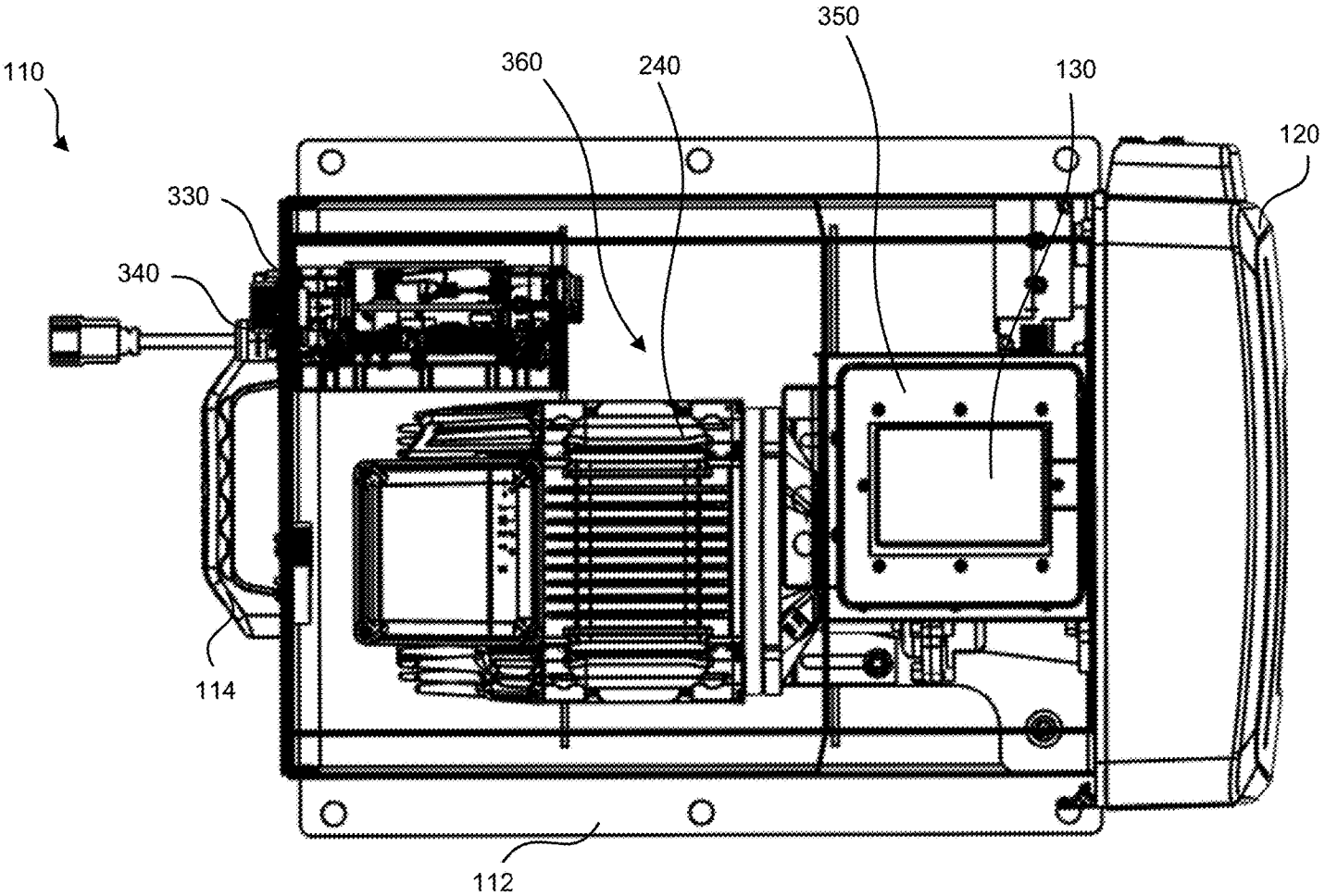
Figure 3E:
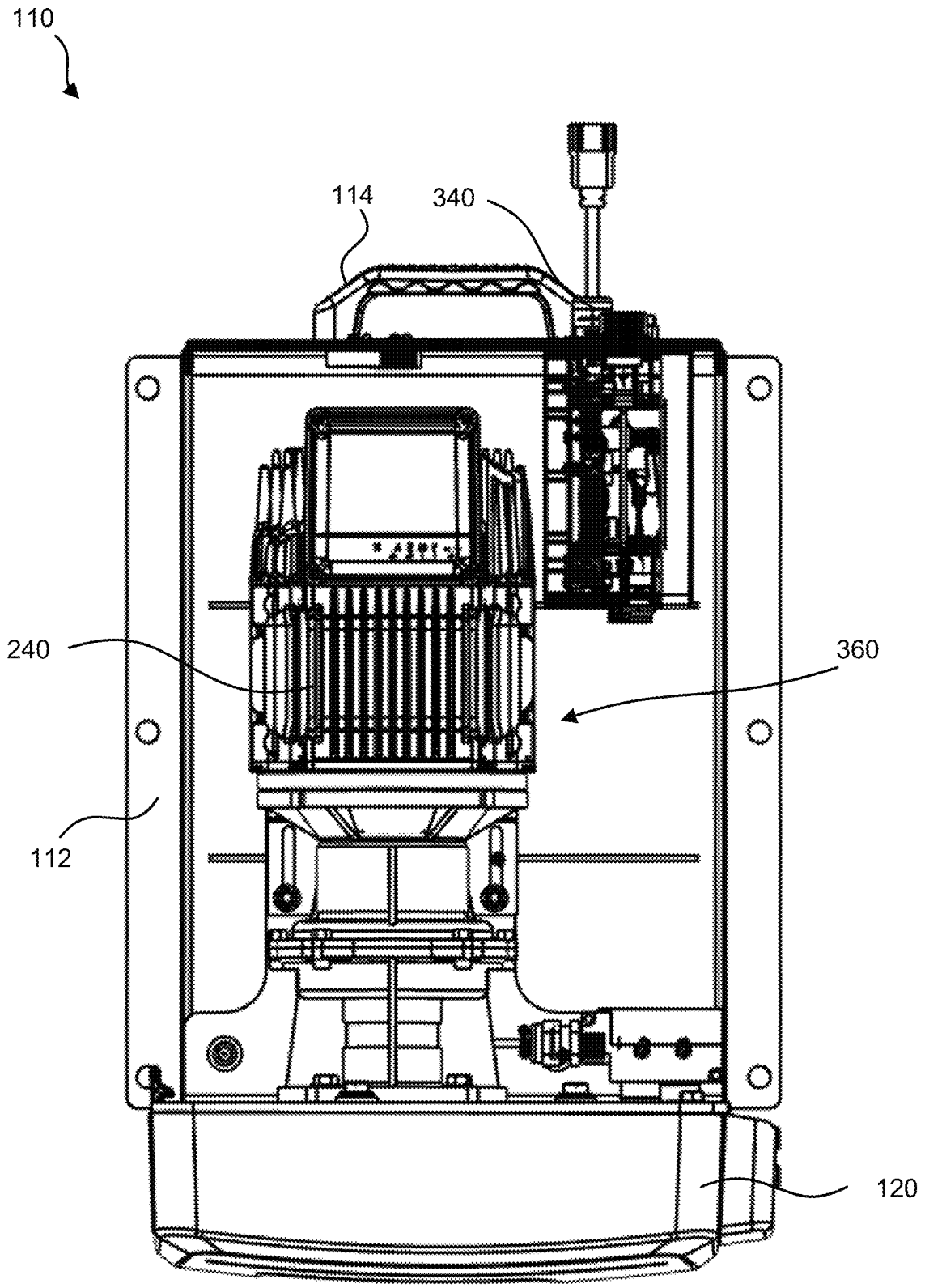

FIGS. 3A-3E illustrate views of various aspects of an example implementation of the enclosure assembly 100 and pump assembly 200 of FIGS. 1 and 2. FIG. 3A illustrates a front prospective view of the enclosure assembly 110 with the access panel 120 in an open position. FIG. 3B illustrates a rear view of the enclosure assembly 110 with the access panel 120 in an closed position. FIG. 3C illustrates a side view of the enclosure assembly 110 with the portions of the housing 110 removed and the access panel 120 in an open position. FIG. 3D illustrates an overhead view of the enclosure assembly 110 with the access panel 120 in a closed position. FIG. 3E illustrates underside view of the enclosure assembly 110 with the access panel 120 in an closed position.

As illustrated by FIG. 3A, the access panel 120 may be hingedly coupled, for example, to the housing 110 via a hinge assembly 310. The access panel 120 may also include a latch 312 to secure the access panel when in the closed position. The latch 312 may include an access switch 314 that prevents operation of and/or turns off the drive motor 240 of the enclosure assembly 110 when the access panel is in an open position. The enclosure assembly 100 may include a pumphead connection assembly 320 having one or more bosses 322 configured to physically mate and/or couple to the pumphead 222 (not shown in FIGS. 3A-3E). The pumphead connection assembly 320 may also include a flange member 324 configured to connect to a fluid channel of the pumphead 222.

As illustrated in FIG. 3B, the enclosure assembly 110 may include an interface panel 330. The interface panel 330 may be mounted onto the housing 110. The interface panel 330 may include one or more electrical ports, connectors, and/or switches. In one illustrative implementation, the interface panel 330 may include a Universal Serial Bus (USB) port 332, an Ethernet port 334, and/or a Profibus port 336 (e.g., a DB9 Profibus port). The interface panel 330 may also include a power switch 338 to turn the pump assembly 200 "on" or "off" The interface panel 330 may also include an electrical power receptacle 340. The interface panel 330 may include one or more sensor connectors 342 configured to electrically couple with one or more sensors (e.g., temperature sensors). In other aspects, the interface panel 400 may include one or more serial ports, parallel ports, telephone jack ports, Interbus ports, Controller Area Network (CAN) ports, Firewire ports, and/or other ports. In an example, one or more protective covers 344 may be attached to the interface panel 330 and/or the enclosure assembly 110 and used to cover one or more of the electrical ports/connectors.

As illustrated by FIG. 3C-3E, the enclosure assembly 110 may include one or more drive components 360 disposed within the housing 110. Some or all of the drive components 360 may be mounted to the base 112. In some implementations, the drive components 360 may include a gear case assembly 362. The gear case assembly 362 may be coupled to the housing 110 via the connection assembly 320. The drive components 360 may include the drive motor 240 configured to drive the pumphead 222 (not shown in FIGS. 3A-3E). The drive components 360 may optionally include a power supply (not shown) configured to convert the line voltage (e.g., 120 volt or 240 volt) from the power receptacle 340 to a direct current (DC) or alternative current (AC) voltage utilized by the drive components 360 for operation.

In an aspect, the enclosure assembly 110 of FIGS. 1 and 3A-3E may include a display assembly 350 for supporting and retaining the display 130 and/or one or more related or other interfacing components, such as the pump controller 260, the processor 250, the memory 252, and/or the network interface 232. Further details of the display assembly 350 are illustrated by FIG. 4.

Figure 4:
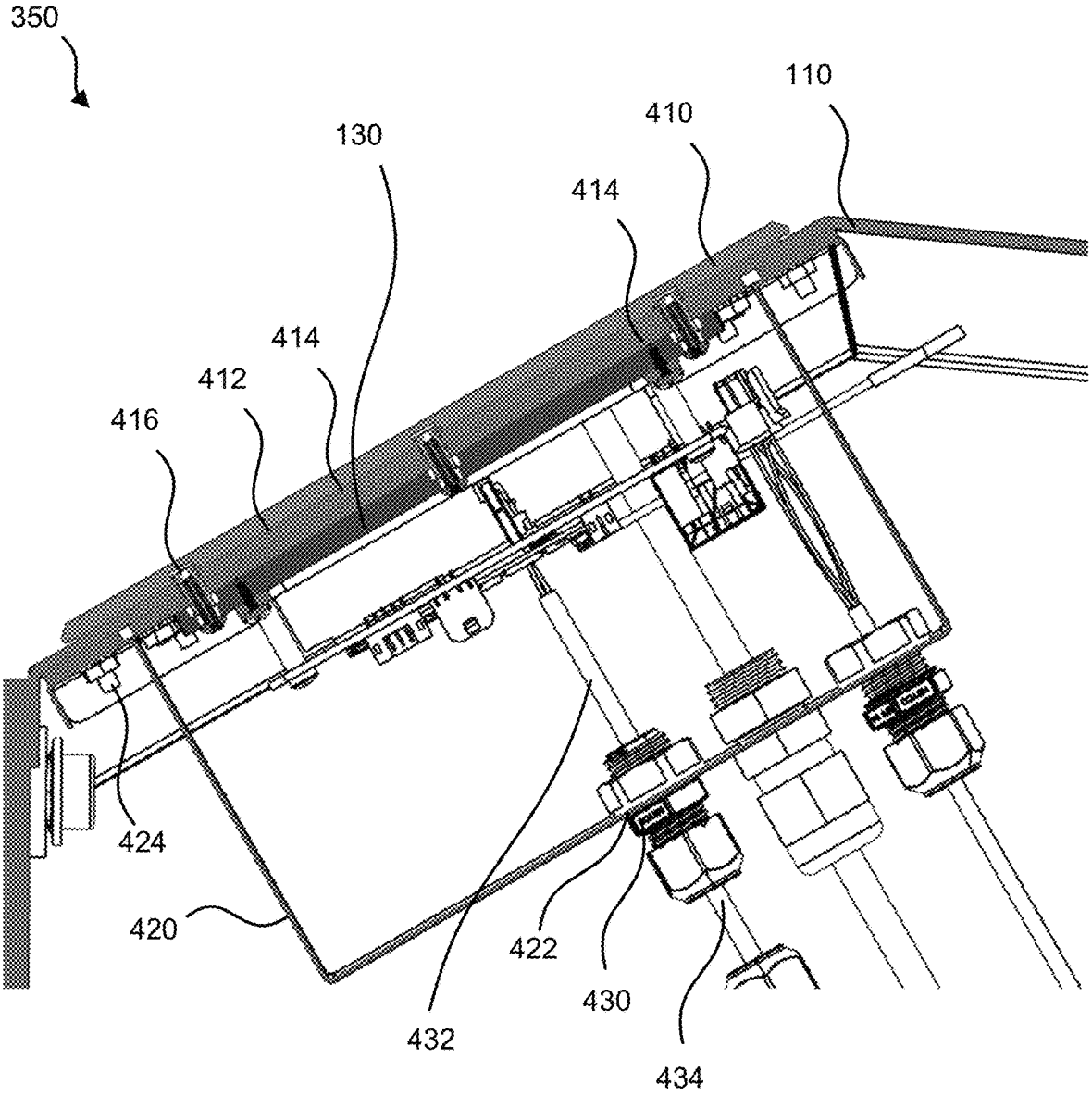
FIG. 4 is a schematic view of a display assembly of the liquid resistant pump of FIG. 1, according to aspects of the present disclosure.

As illustrated by FIG. 4, the display assembly 350 may include a mounting frame 410 that mounts to the housing 110 and provides viewing and touch access to the display 130. In an example, the mounting frame 410 may encapsulate at least a portion of the display 130. At least a portion of the display 130 may thereby be disposed between the housing 110 and the mounting frame 410.

In an example, one or more membranes 412 of FIG. 4 may be positioned between the mounting frame 410 and the display 130 to seal the display assembly 350 and prevent undesired environmental materials (e.g., dirt or liquid) from entering the display assembly 350 and/or the display 130. In an example, one or more gaskets 414 (FIG. 4) may be emplaced for substantially sealing any gap between an underside surface of the mounting frame 410 and the housing 110 and/or between the display 130 and the housing 110.

As further illustrated by FIG. 4, in an example, one or more fasteners 416 may fasten the mounting frame 410 to the housing 110. The one or more fasteners 416 may be or include, but are not limited to, one or more screws, nails, bolts, battens, buckles, clamps, clips, pegs, or pins. In one example, the one or more fasteners 416 may be mateably inserted (e.g., screwed) into one or more bosses (not shown) to prevent the mounting frame 410 from over-compressing the display 130, thus avoiding the display 130 from being distorted, delaminated, and/or discolored. The mounting frame 410, when encapsulating the display 130, may reduce and/or prevent fluid, moisture, debris, and/or other contaminants from contacting or remaining contact with the display 130.

The display assembly 350 may also include a display enclosure 420, as illustrated by FIG. 4, to separate the display 130 and/or additional components from the cavity formed by the housing 110. The display enclosure 420 may include one or more openings 422 that allow one or more connectors 430 to attach to the display enclosure 420. Use of the combination of the one or more openings 422, and the one or more connectors 430 received therein may provide strain relief and/or other benefits for wiring 432 extending between the components of the display assembly 350 and the display enclosure 420 and also wiring 434 between the display enclosure 420 and other components that may, for example, be located within the housing 110. In an example, the display enclosure 420 may mount to a bottom surface of the housing 110 by one or more fasteners 424. Examples of the one or more fasteners 424 may include those listed herein for the fasteners 416. However, in other examples, the display enclosure 420 may be fixed to the housing 110.

Figure 5:
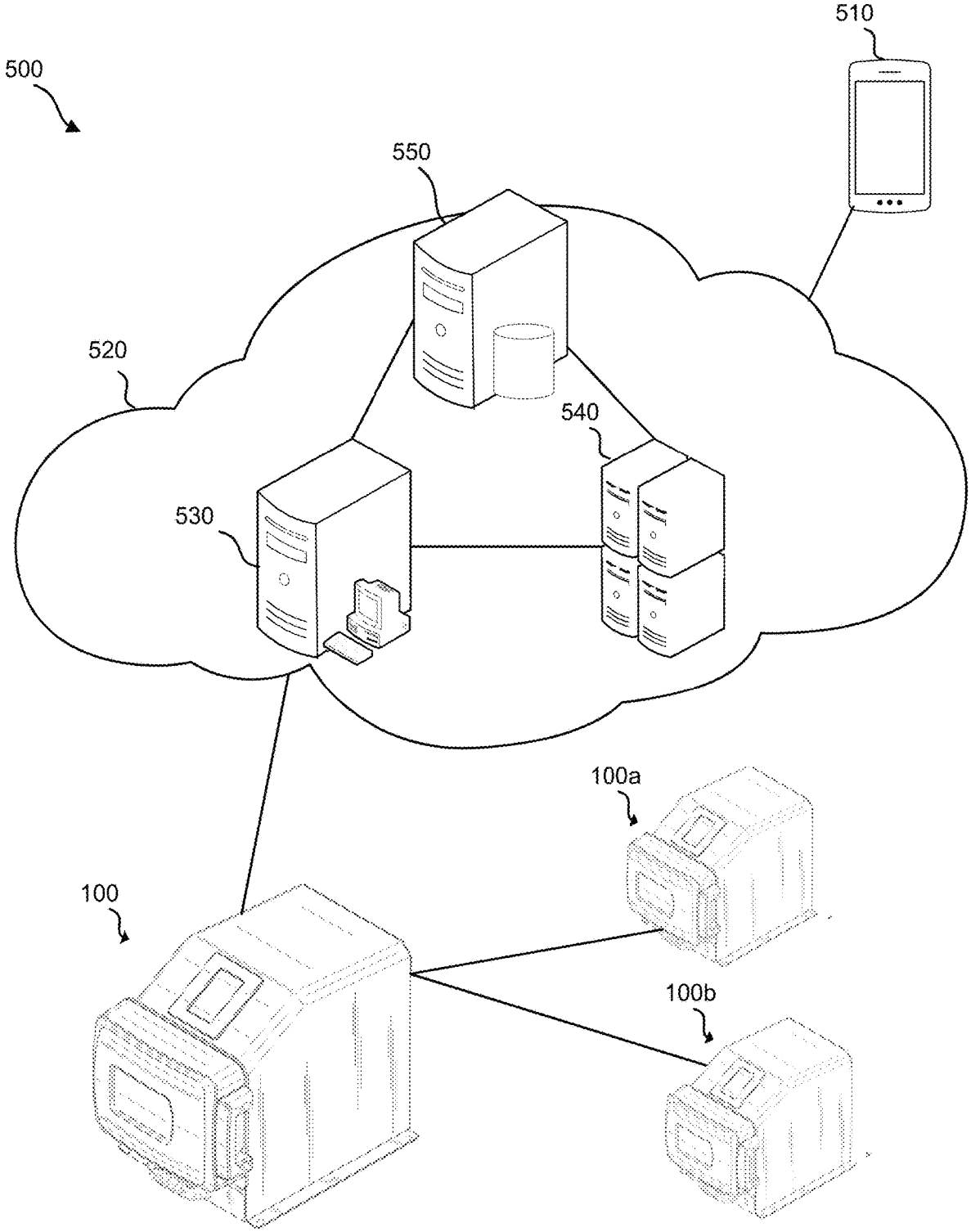
FIG. 5 is schematic diagram of an example network environment for a pump, according to aspects of the present disclosure.

FIG. 5 is a representative schematic diagram of an example network environment 500 in which the pump assembly 200, in accordance with aspects of the present disclosure, may be utilized. The network environment 500 may include a user device 510 (examples of which may also interchangeably be referred to herein as "terminals") for providing a user interface to a user, a communication network 520 for transmitting various communications among devices as described herein, a command server 530 for publishing commands to one or more pump assemblies 100, 100*a*, and 100*b*, an application server 540 for providing an application to the user device 510, and a database server 550 for storing data reported by one or more pump assemblies 100 and user devices 510.

The user device 510 may include various computing devices that may be used to access an application via a web interface. For example, the user device 510 may be or include any mobile or fixed computer device, including but not limited to a desktop or laptop or tablet computer, a cellular telephone, a gaming device, a mixed reality or virtual reality device, a music device, a television, a navigation system, a camera, a personal digital assistant (PDA), a handheld device, or any other suitable computer device having wired and/or wireless connection capability with one or more other devices. The user device 510 may include a processor that executes an operating system and one or more applications. In an aspect, the user device 510 may execute a dedicated application for providing a user interface to the pump control application server 540. In another aspect, the user device 510 may execute a web browser application to access a webpage providing a user interface to the pump control application server 540. In an aspect, the user device 510 may be configured for secure communication with the application server 540. For example, the user device 510 may install a certificate of the application server 540 allowing device verification and encrypted communications.

The communication network 520 may be or include a computer network that allows communication among various devices. For example, the communication network 520 may include the Internet and may transmit data packets according to the Internet protocol. As illustrated, the communication network 520 may include the command server 530, application server 540, and database server 550. In an aspect, the command server 530, application server 540, and database server 550 may be implemented using a cloud architecture. For example, the command server 530, application server 540, and database server 550 may each be implemented as a virtual server to be provided by a cloud services provider. The cloud service provider may generate instances of the virtual servers using geographically dispersed computing hardware. A cloud architecture may provide scalability, load balancing, stability against network interruptions, and redundancy of stored data, among other features. It should be appreciated that the command server 530, application server 540, and database server 550 may also be implemented using conventional computer servers configured to execute the programs described herein.

The command server 530 may include one or more computer servers configured to publish commands to one or more pump assemblies 100, for example. In an aspect, the command server 530 may use a publish-subscribe based messaging protocol. For example, the command server 530 may use Message Queuing Telemetry Transport (MQTT) protocol. In an aspect, the use of a publish-subscribe based messaging protocol may provide security by having the pump assembly 200 establish a connection to a known server, rather than accepting a connection from potentially different sources.

The command server 530 may publish commands to control the pump assembly 200. The control may include commands for the pump assembly 200 to provide information. The commands may be associated with a command string or topic, which may include an identifier (id) of the pump assembly 200 that should execute the command. The identifier may be, for example, a media access control (MAC) address of the pump assembly 200. The commands may also include one or more parameters for executing the command. Table 1, below, includes a listing of example commands that may be used with the pump assembly 200.

TABLE 1

| TOPIC | DESCRIPTION |
|---|---|
| mflx/id/sts/online | Powerup and Last Will Topic, message = "true" or "false" |
| mflx/id/sts/Uptime | Time since power up and Date/Time. JSON |
| mflx/id/sts/Info | RPM, Model, Adapter and Connection. JSON |
| mflx/id/sts/RunStatus | JSON<br>true = pump motor on, false = pump motor off |

TABLE 1-continued

| TOPIC | DESCRIPTION |
|---|---|
| | true = dispense on, false = dispense off |
| | true = sensor open, false = sensor closed |
| | error code (0 = status OK) |
| mflx/id/sts/FlowDir | Flow direction, "CW" or "CCW" |
| mflx/id/sts/RemCont | "1" = Remote, "0" = Local |
| mflx/id/sts/DispMode | "Continuous", "Time" or "Volume" |
| mflx/id/sts/Tube | Size and calibration status in JSON |
| | "1", "2", . . . , "N" where N = last tube size selection |
| | false = tube not calibrated, true = calibrated |
| mflx/id/sts/FlowUnits | "1", "2", . . . , "N" where N = last flow units selection |
| mflx/id/sts/CumVol | Cumulative volume (Text string of float number) |
| mflx/id/sts/RemDisp | Remaining dispense volume and time in JSON |
| mflx/id/sts/BatchCount | Batch Count current and total in JSON |
| mflx/id/sts/FlowRate | Current, Min and Max flow rates in JSON |
| mflx/id/sts/NeedTimestamp | Request to server to send Unix Timestamp (no message) |

The command server 530 may implement a program for the pump assembly 200 by publishing commands. For example, the command server 530 may receive a selection of a program from the application server 540. The selected program may include a series of commands and parameters. The command server 530 may publish the commands at the appropriate time to control the pump assembly 200 to operate according to the program. Additionally, the command server 530 may receive feedback from the pump assembly 200 (e.g., in response to Get command). The command server 530 may evaluate conditions based on the feedback for executing the program. In an aspect, the command server 530 may be implemented as a remote server that provides commands for multiple pump assembly 200, which may be owned by different organizations, for example. In another aspect, a local command server may be implemented (e.g., by an organization) to allow control of local pump assembly 200. For example, a command server 530 may be implemented on a user device 510 and communicate via a local area network (LAN) or other short-range communication protocol.

Application server 540 may include one or more computer servers configured to provide a user interface accessible via a user device 510. The application server 540 may communicate with dedicated applications executing on user devices 510 or may provide a web-based interface accessible via a web browser, for example. As described in further detail below, in one or more example implementations, the user interface provided by the application server 540 may allow a user to configure one or more pump assemblies 100 for operation. The application server 540 may also perform monitoring of the pump assemblies 100 and provide alerts to the user devices 510. The user interface may allow the user device 510 to configure which alerts to receive and how the alerts are received (e.g., via application notification, text, or email).

Database server 550 may store information collected from one or more pump assemblies 100 via the command server 530. The database server 550 may provide data security and integrity protection, for example. In an aspect, the database server 550 may collect and store data that may be reported to regulatory agencies, for example, as evidence of laboratory processes. The database server 550 may provide data security using secure socket layer (SSL) certificates to encrypt data between the pump assemblies 100 and the database server 550. Additionally, access to the database server 550, as well as the application server 540 and command server 530, may be controlled using authenticated user names and passwords, for example. Actions on any of the servers may be attributed to a specific user. The database server 550 may generate an audit trail indicating which users performed actions at which time. Further, because the pump assemblies 100 may be operated in either local mode or remote mode, the database server 550 may track actions taken in local mode even if a registered user is not identified. For example, the actions performed in local mode may therefore be attributed to a local user.

The database server 550 may segregate data of multiple customers. For example, a customer (e.g., a laboratory, corporation, or other entity), may have access only to data associated with devices belonging to the customer. A customer may designate multiple registered users (e.g., employees), who may access data based on user role. For example, the database server 550 may allow access to users based on a security level. For instance, an administrator may be able to configure database storage, export data, annotate data, and generate audit reports, while a regular user may only be able to read or export data. Additionally, a system administrator may not be associated with any customer and may at least read any data.

In an aspect, a pump assembly 200 may be communicatively coupled with one or more additional pump assemblies 100*a* and 100*b*. In this arrangement, the pump assembly 200 may control the one or more additional pump assemblies 100*a* and 100*b*, similar to user device 510, as described herein. Further, in some examples, any remote communications from one or more of the user device 510, the application server 540, etc. are communicated via the pump assembly 200.

Figure 6:
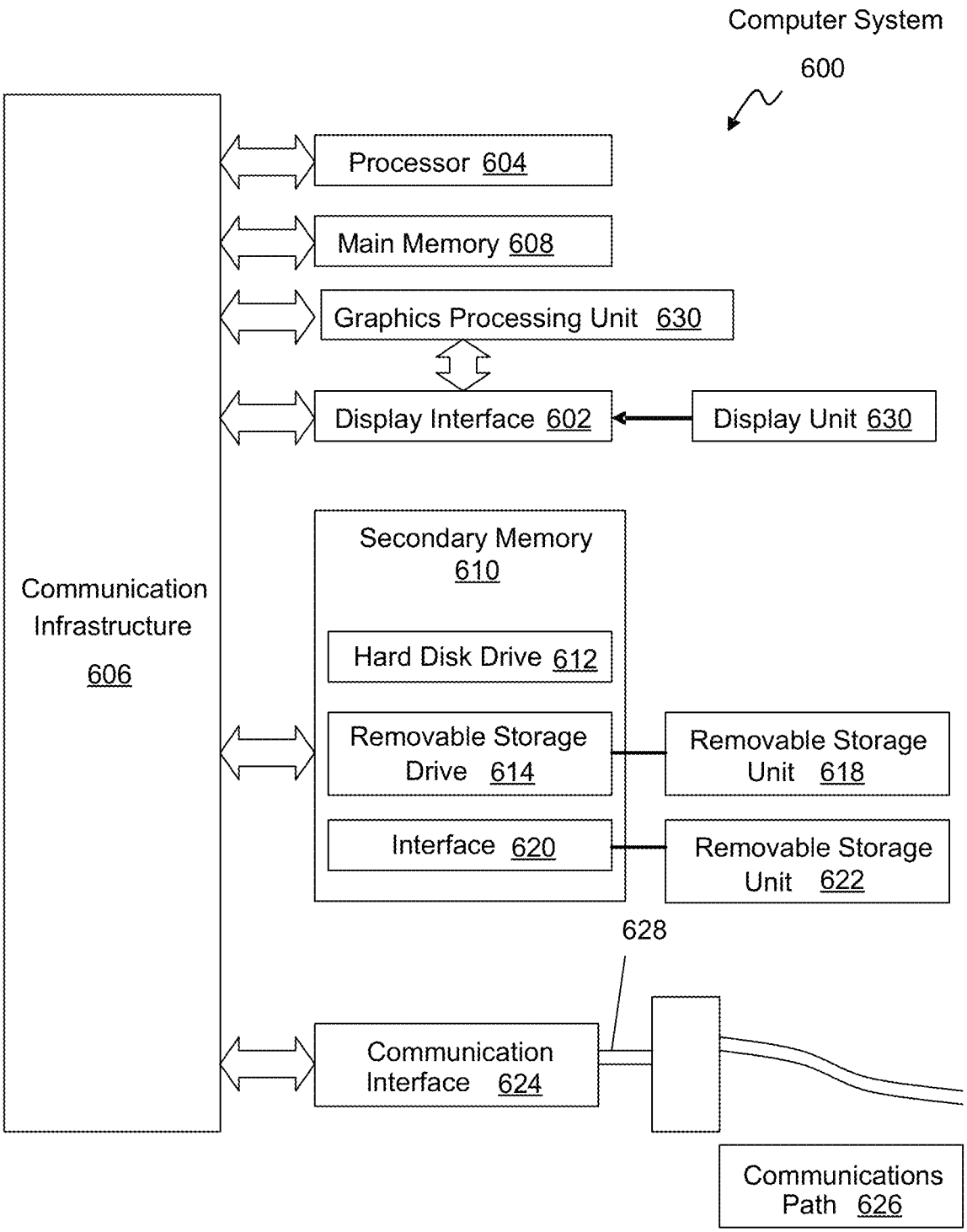
FIG. 6 is an example system diagram of various hardware components and other features, according to aspects of the present disclosure.

Aspects of the present disclosure may be implemented using hardware, software, or a combination thereof and may be implemented in one or more computer systems or other processing systems. In one aspect, the disclosure is directed toward one or more computer systems capable of carrying out the functionality described herein. FIG. 6 presents an example system diagram of various hardware components and other features that may be used in accordance with aspects of the present disclosure. Aspects of the present disclosure may be implemented using hardware, software, or a combination thereof and may be implemented in one or more computer systems or other processing systems. In one example variation, aspects of the disclosure are directed toward one or more computer systems capable of carrying out the functionality described herein. An example of such a computer system 600 is shown in FIG. 6.

Computer system 600 includes one or more processors, such as processor 604. The processor 604 is connected to a communication infrastructure 606 (e.g., a communications bus, cross-over bar, or network). Various software aspects are described in terms of this example computer system. After reading this description, it will become apparent to a person skilled in the relevant art(s) how to implement aspects of the disclosure using other computer systems and/or architectures.

Computer system 600 may include a display interface 602 that forwards graphics, text, and other data from the communication infrastructure 606 (or from a frame buffer not shown) for display on a display unit 630. Computer system 600 also includes a main memory 608, preferably random access memory (RAM), and may also include a secondary memory 610. The secondary memory 610 may include, for example, a hard disk drive 612 and/or a removable storage drive 614, representing a floppy disk drive, a magnetic tape drive, an optical disk drive, etc. The removable storage drive 614 reads from and/or writes to a removable storage unit 618 in a well-known manner. Removable storage unit 618, represents a floppy disk, magnetic tape, optical disk, etc., which is read by and written to removable storage drive 614. As will be appreciated, the removable storage unit 618 includes a computer usable storage medium having stored therein computer software and/or data.

In alternative aspects, secondary memory 610 may include other similar devices for allowing computer programs or other instructions to be loaded into computer system 600. Such devices may include, for example, a removable storage unit 622 and an interface 620. Examples of such may include a program cartridge and cartridge interface (such as that found in video game devices), a removable memory chip (such as an erasable programmable read only memory (EPROM), or programmable read only memory (PROM)) and associated socket, and other removable storage units 622 and interfaces 620, which allow software and data to be transferred from the removable storage unit 622 to computer system 600.

Computer system 600 may also include a communications interface 624. Communications interface 624 allows software and data to be transferred between computer system 600 and external devices. Examples of communications interface 624 may include a modem, a network interface (such as an Ethernet card), a communications port, a Personal Computer Memory Card International Association (PCMCIA) slot and card, etc. Software and data transferred via communications interface 624 are in the form of signals 628, which may be electronic, electromagnetic, optical or other signals capable of being received by communications interface 624. These signals 628 are provided to communications interface 624 via a communications path (e.g., channel) 626. This path 626 carries signals 628 and may be implemented using wire or cable, fiber optics, a telephone line, a cellular link, a radio frequency (RF) link and/or other communications channels. In this document, the terms "computer program medium" and "computer usable medium" are used to refer generally to media such as a removable storage drive 680, a hard disk installed in hard disk drive 670, and signals 628. These computer program products provide software to the computer system 600. Aspects of the disclosure are directed to such computer program products.

Computer programs (also referred to as computer control logic) are stored in main memory 608 and/or secondary memory 610. Computer programs may also be received via communications interface 624. Such computer programs, when executed, enable the computer system 600 to perform various features in accordance with aspects of the present disclosure, as discussed herein. In particular, the computer programs, when executed, enable the processor 604 to perform such features. Accordingly, such computer programs represent controllers of the computer system 600.

In variations where aspects of the disclosure are implemented using software, the software may be stored in a computer program product and loaded into computer system 600 using removable storage drive 614, hard disk drive 612, or communications interface 620. The control logic (software), when executed by the processor 604, causes the processor 604 to perform the functions in accordance with aspects of the disclosure as described herein. In another variation, aspects are implemented primarily in hardware using, for example, hardware components, such as application specific integrated circuits (ASICs). Implementation of the hardware state machine so as to perform the functions described herein will be apparent to persons skilled in the relevant art(s).

In yet another example variation, aspects of the disclosure are implemented using a combination of both hardware and software.

Figure 7:
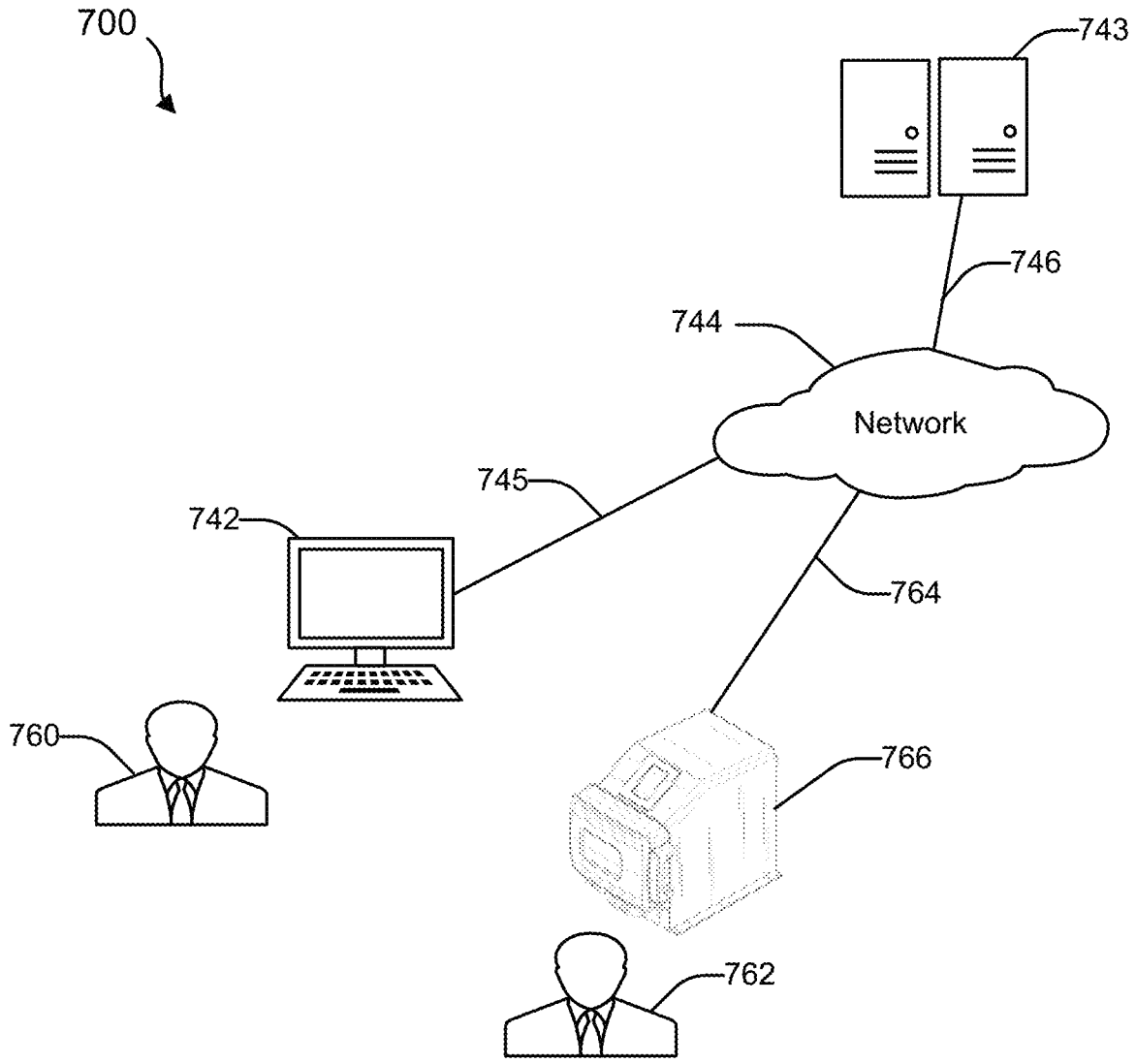
FIG. 7 is a block diagram of various exemplary system components, according to aspects of the present disclosure.

FIG. 7 is a block diagram of various additional example system components (e.g., on a network) that may be used in accordance with aspects of the present disclosure. The system 700 may include one or more accessors 760, 762 (also referred to interchangeably herein as one or more "users") and one or more terminals 742, 766 (e.g., enclosure assembly 100). The accessors 760, 762 may correspond to user devices 510. In one aspect, data for use in accordance with aspects of the present disclosure may, for example, be input and/or accessed by accessors 760, 762 via terminals 742, 766, such as personal computers (PCs), minicomputers, mainframe computers, microcomputers, telephonic devices, or wireless devices, such as personal digital assistants ("PDAs") or a hand-held wireless devices coupled to a server 743, such as a PC, minicomputer, mainframe computer, microcomputer, or other device having a processor and a repository for data and/or connection to a repository for data, via, for example, a network 744, such as the Internet or an intranet, and couplings 745, 746, 764. The couplings 745, 746, 764 include, for example, wired, wireless, or fiber optic links. In another example variation, the method and system in accordance with aspects of the present disclosure operate in a stand-alone environment, such as on a single terminal.

Additional Example Implementations

An example pump assembly, comprising: a motor; a housing forming an enclosure cavity to enclose the motor; a display assembly comprising: a mounting frame mounted to a first surface of the housing and having an opening for viewing a display; a gasket positioned between the mounting frame and the housing; and one or more membranes positioned between the mounting frame and the display; a pumphead connection assembly positioned on a second surface of the housing; and an access panel attached to the housing and positioned to selectively provide access to the pumphead connection assembly.

The example pump assembly above, wherein the access panel comprises a viewing panel for viewing the pumphead connection assembly.

One or more of the above example pump assemblies, further comprising a switch configured to disable a pump when the access panel is opened.

One or more of the above example pump assemblies, wherein the display assembly further comprises: a strain relief housing positioned within the enclosure cavity of the housing and configured to provide strain relief for one or more electrical connections from the display.

One or more of the above example pump assemblies, wherein the strain relief is further configured to provide a waterproof cavity for the one or more electrical connections from the display.

One or more of the above example pump assemblies, further comprising an antenna positioned in the strain relief housing.

One or more of the above example pump assemblies, wherein the housing is formed of a noncorrosive material.

One or more of the above example pump assemblies, further comprising one or more electrical ports positioned on a second surface of the housing, the one or more electrical ports configured to provide electrical connection between an external connection and one or more of the display or the motor.

One or more of the above example pump assemblies, wherein the motor is a waterproof motor.

One or more of the above example pump assemblies, wherein the access panel is hingedly attached to the housing.

An example enclosure assembly, comprising: a housing forming an enclosure cavity to enclose a pump; a display assembly comprising: a mounting frame mounted to a first surface of the housing and having an opening for viewing a display; and one or more membranes positioned between the mounting frame and the display; a pumphead connection assembly positioned on a second surface of the housing; and an access panel is attached to the housing and positioned to selectively provide access to the pumphead connection assembly.

The above example enclosure assembly, wherein the access panel comprises a viewing panel for viewing the pumphead connection assembly.

One or more of the above example enclosure assemblies, further comprising a switch configured to disable a motor when the access panel is opened.

One or more of the above example enclosure assemblies, wherein the display assembly further comprises: a strain relief housing positioned within the enclosure cavity of the housing and configured to provide strain relief for one or more electrical connections from the display.

One or more of the above example enclosure assemblies, wherein the strain relief is further configured to provide a waterproof cavity for the one or more electrical connections from the display.

One or more of the above example enclosure assemblies, further comprising an antenna positioned in the strain relief housing.

One or more of the above example enclosure assemblies, wherein the housing is formed of a noncorrosive material.

One or more of the above example enclosure assemblies, further comprising one or more electrical ports positioned on a second surface of the housing, the one or more electrical ports configured to provide electrical connection between an external connection and one or more of the display or a pump.

One or more of the above example enclosure assemblies, wherein the access panel is hingedly attached to the housing.

The aspects of the disclosure discussed herein may also be described and implemented in the context of computer-readable storage medium storing computer-executable instructions. Computer-readable storage media includes computer storage media and communication media. For example, flash memory drives, digital versatile discs (DVDs), compact discs (CDs), floppy disks, and tape cassettes. Computer-readable storage media may include volatile and nonvolatile, removable and non-removable media implemented in any method or technology for storage of information such as computer readable instructions, data structures, modules or other data.

This written description uses examples to disclose aspects of the present disclosure, including the preferred embodiments, and also to enable any person skilled in the art to practice the aspects thereof, including making and using any devices or systems and performing any incorporated methods. The patentable scope of these aspects is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Aspects from the various embodiments described, as well as other known equivalents for each such aspect, can be mixed and matched by one of ordinary skill in the art to construct additional embodiments and techniques in accordance with principles of this application.

What is claimed is:

1. A pump assembly, comprising:

a motor;

a pump housing forming an enclosure cavity to enclose the motor;

a display assembly comprising:

a display;

a mounting frame mounted to a first surface of the pump housing that faces outward from the pump housing, the mounting frame having an opening for viewing the display;

a gasket positioned between the mounting frame and the pump housing;

one or more membranes positioned between the mounting frame and the display;

a strain relief housing positioned within the enclosure cavity of the pump housing and configured to provide strain relief for one or more electrical connections from the display, the strain relief housing being attached with attachments to a second surface of the pump housing on the opposite side of the pump housing from the first surface, the attachments facing inward into the pump housing and located outside the strain relief housing so that the attachments are only accessible from inside the pump housing, the strain relief housing configured to provide a waterproof cavity for the one or more electrical connections from the display, wherein a portion of the pump housing is located between the strain relief housing and the mounting frame so that the strain relief housing is not directly mounted to or in contact with the mounting frame; and wherein the display is positioned within the strain relief housing and is attached with attachments to the pump housing on the second surface of the pump housing, the attachment of the display to the pump housing being located within the strain relief housing with the attachments only accessible from within the strain relief housing;

a pumphead connection assembly positioned on the second surface of the pump housing; and an access panel attached to the pump housing and positioned to selectively provide access to the pumphead connection assembly.

2. The pump assembly of claim 1, wherein the access panel comprises a viewing panel for viewing the pumphead connection assembly.

3. The pump assembly of claim 1, further comprising a switch configured to disable a pump when the access panel is opened.

4. The pump assembly of claim 1, further comprising an antenna positioned in the strain relief housing.

5. The pump assembly of claim 1, wherein the pump housing is formed of a noncorrosive material.

6. The pump assembly of claim 1, further comprising one or more electrical ports positioned on another surface of the pump housing, the one or more electrical ports configured to provide electrical connection between an external connection and one or more of the display or the motor.

7. The pump assembly of claim 1, wherein the motor is a waterproof motor.

8. The pump assembly of claim 1, wherein the access panel is hingedly attached to the pump housing.

9. The pump assembly of claim 1, further comprising a second gasket located between the second surface of the pump housing and a first side of the display.

10. An enclosure assembly, comprising:

a pump housing forming an enclosure cavity to enclose a pump;

a display assembly comprising:

a display;

a mounting frame mounted to a first surface of the pump housing that faces outward from the pump housing, the mounting frame having an opening for viewing the display;

one or more membranes positioned between the mounting frame and the display;

a strain relief housing positioned within the enclosure cavity of the pump housing and configured to provide strain relief for one or more electrical connections from the display, the strain relief housing being attached with attachments to a second surface of the pump housing on the opposite side of the pump housing from the first surface, the attachments facing inward into the pump housing and located outside the strain relief housing so that the attachments are only accessible from inside the pump housing, the strain relief housing configured to provide a waterproof cavity for the one or more electrical connections from the display, wherein a portion of the pump housing is located between the strain relief housing and the mounting frame so that the strain relief housing is not directly mounted to or in contact with the mounting frame; and wherein the display is positioned within the strain relief housing and is attached to the pump housing on the second surface of the pump housing, the attachment of the display to the pump housing being positioned within the strain relief housing with the attachments only accessible from within the strain relief housing;

a pumphead connection assembly positioned on a second surface of the pump housing; and an access panel is attached to the pump housing and positioned to selectively provide access to the pumphead connection assembly.

11. The enclosure assembly of claim 10, wherein the access panel comprises a viewing panel for viewing the pumphead connection assembly.

12. The enclosure assembly of claim 10, further comprising a switch configured to disable a motor when the access panel is opened.

13. The enclosure assembly of claim 10, further comprising an antenna positioned in the strain relief housing.

14. The enclosure assembly of claim 10, wherein the pump housing is formed of a noncorrosive material.

15. The enclosure assembly of claim 10, further comprising one or more electrical ports positioned on another surface of the pump housing, the one or more electrical ports configured to provide electrical connection between an external connection and one or more of the display or a pump.

16. The enclosure assembly of claim 10, wherein the access panel is hingedly attached to the pump housing.

17. The enclosure assembly of claim 10, further comprising a second gasket located between the second surface of the pump housing and a first side of the display.

* * * * *